US011474467B2

(12) United States Patent
Yamamoto

(10) Patent No.: US 11,474,467 B2
(45) Date of Patent: Oct. 18, 2022

(54) OPERATING UNIT AND IMAGE FORMING APPARATUS

(71) Applicant: CANON KABUSHIKI KAISHA, Tokyo (JP)

(72) Inventor: Daisuke Yamamoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/398,640

(22) Filed: Aug. 10, 2021

(65) Prior Publication Data

US 2022/0066371 A1 Mar. 3, 2022

(30) Foreign Application Priority Data

Aug. 25, 2020 (JP) ..... JP2020-142053

(51) Int. Cl.
*G03G 15/00* (2006.01)

(52) U.S. Cl.
CPC ..... *G03G 15/5016* (2013.01)

(58) Field of Classification Search
CPC .. G03G 15/5016; G03G 15/502; H01H 13/02; H01H 13/14; G08B 21/16
See application file for complete search history.

(56) References Cited

U.S. PATENT DOCUMENTS

| | | | | |
|---|---|---|---|---|
| 5,912,443 | A * | 6/1999 | Hasunuma | H01H 13/705 200/5 A |
| 6,887,001 | B2 | 5/2005 | Kitamura et al. | 400/490 |
| 8,253,051 | B2 * | 8/2012 | Dai | H01H 13/52 200/345 |
| 9,058,060 | B2 * | 6/2015 | Kuo | G06F 3/0202 |

FOREIGN PATENT DOCUMENTS

| | | |
|---|---|---|
| JP | S58-87219 U | 6/1983 |
| JP | 2002-343180 | 11/2002 |
| JP | 2008-299444 | 12/2008 |
| JP | 2011-029063 | 2/2011 |

* cited by examiner

*Primary Examiner* — Hoang X Ngo
(74) *Attorney, Agent, or Firm* — Venable LLP

(57) ABSTRACT

An image forming apparatus includes a control substrate, an operating unit including a button, a button member and a substrate including a switch provided below the button member. The button member includes a pressing portion for pressing the switch, first and second elastic portions, and an abutting portion capable of contacting a portion other than the switch of the substrate. As viewed from a pressing direction, the switch and the pressing member are disposed in a place other than a center of the button, the abutting portion is positioned in one side and the pressing portion is in the other side with respect to a virtual line connecting a first connecting portion and a second connecting portion connecting the first and second elastic portion and the button, respectively. The abutting portion is disposed on a position overlapping with a contour of the operating portion or a position non-overlapping with the operating portion.

15 Claims, 10 Drawing Sheets

OPERATING UNIT AND IMAGE FORMING APPARATUS

FIELD OF THE INVENTION AND RELATED ART

The present invention relates to an image forming apparatus, and in particular to an image forming apparatus provided with an operating unit.

In recent years, there has been a need to downsize image forming apparatuses such as copiers, printers, and FAXs, etc. Various operating units such as mechanical button switches and electrostatic touch panels have been adopted for image forming apparatuses. In the Japanese Laid-Open Patent Application No. 2008-299444, the contact portion is placed near the center of the mechanical button to ensure operability when the user presses the button.

SUMMARY OF THE INVENTION

The present invention aims to provide a configuration that can maintain operability even when the size is reduced, the visibility of the buttons is improved, and the design of the image forming apparatus is further improved.

According to an aspect of the present invention, there is provided an image forming apparatus comprising: an image forming unit configured to form an image on a recording material; a control substrate configured to control said image forming unit; and an operating unit connected to said control substrate, wherein said operating unit including a button capable of being pressed by a user, a button member configured to hold said button, and a substrate including a switch provided below said button member and pressed by said button being pressed, wherein said button member including a pressing portion for pressing said switch, a first elastic portion elastically deformed and connected to said pressing portion, a second elastic portion elastically deformed and connected to said pressing portion, and an abutting portion capable of contacting a portion other than said switch of said substrate, wherein when viewing said button from a pressing direction, said switch and said pressing member are disposed in a place other than a center of said button, said abutting portion is positioned in one side and said pressing portion is in the other side with respect to a virtual line connecting a first connecting portion connecting said first elastic portion and said button, and a second connecting portion connecting said second elastic portion and said button, and said abutting portion is disposed on a position overlapping with a contour of said operating portion or a position non-overlapping with said operating portion.

Further features of the present invention will become apparent from the following description of exemplary embodiments (with reference to the attached drawings).

DESCRIPTION OF THE EMBODIMENTS

[Image Forming Apparatus]

Figure 1:
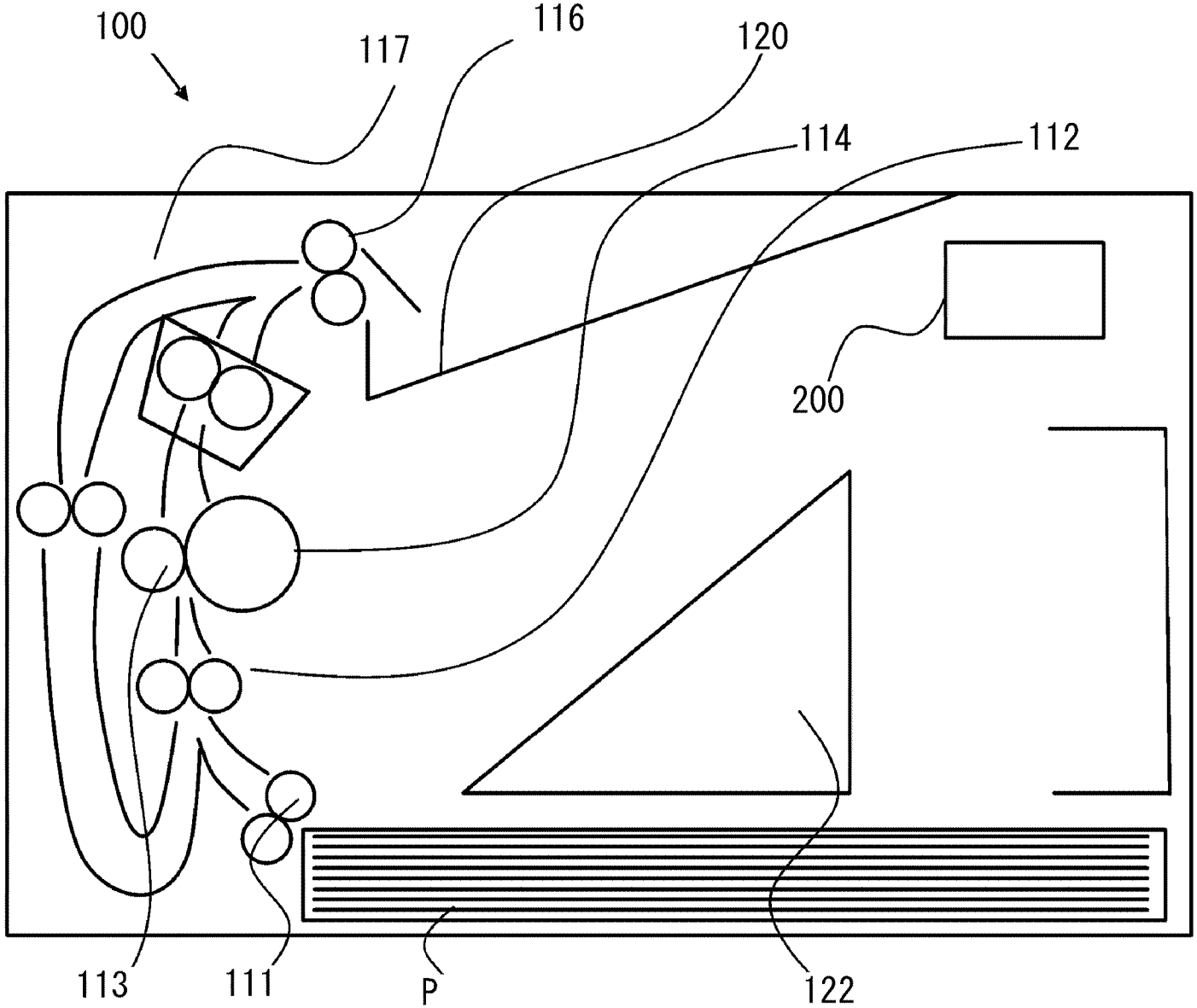
FIG. 1 is a cross-sectional view of the laser beam printer in embodiments 1-3

The following is a description of the embodiments of the present invention in FIG. 1. The laser beam printer (hereinafter referred to as the printer 100), which is an example of the present invention, has an image forming unit that forms images, a sheet feeding unit that separates and feeds sheets P, which are recording materials, one by one to the image forming unit, a laser scanner unit, a fixing device, and a discharge tray.

Here, the image forming unit is equipped with a process cartridge, transfer roller, etc. that can be attached to and detached from the main assembly of the printer 100. The process cartridge is equipped with a photosensitive drum, an electrostatic roller, a developing device, a cleaning device, and so on.

When image information is sent from an external device such as a personal computer to the printer 100, and when the control portion 200, which has processed the image information, sends out a print signal as a print command, the printer 100 controls the components shown in FIG. 1 as follows to form an image. The control portion 200 has, for example, a CPU, ROM, RAM, etc. The CPU reads various programs memorized in the ROM and executes them while using the RAM as a temporary work area. The control portion 200 is mounted on the control substrate.

First, when the paper feeding roller 111 is rotated, the sheet P stacked in the paper feed cassette is fed into the feeding path. In addition, the sheet P is fed by the feeding roller 112 to the transfer roller 113. On the other hand, a latent image is formed on the photosensitive drum 114 by the laser light emitted from the laser scanner 122 based on the image information together with the print command. The latent image on the photosensitive drum becomes a toner image when toner is applied by the developing unit (not shown). The toner image formed on the photosensitive drum 114 is transferred to the sheet P by the transfer roller 113. In this way, an unfixed toner image is formed on the first side (or surface) of the sheet P. The sheet P is sent to the fixing unit 115, where the unfixed toner image is fixed. In single-sided printing, the sheet P is discharged into the discharge tray by the discharging roller 116. When double-side printing is performed, the sheet P is reversed in the feeding direction by the discharging roller 116, passes through the double-side feeding path 117, and again passes through the feeding roller 112, where the toner image is formed on the second side (or back side) of the sheet P in the same way as in single-sided printing, and is discharged into the discharge tray 1. The configuration of the image forming apparatus with the operating unit of the present invention described in the following embodiment is not limited to the configuration in FIG. 1, but may be any other configuration of image forming apparatus, such as a color image forming apparatus, for example.

Exemplary Embodiment 1

[Operating Unit]

Figure 2:
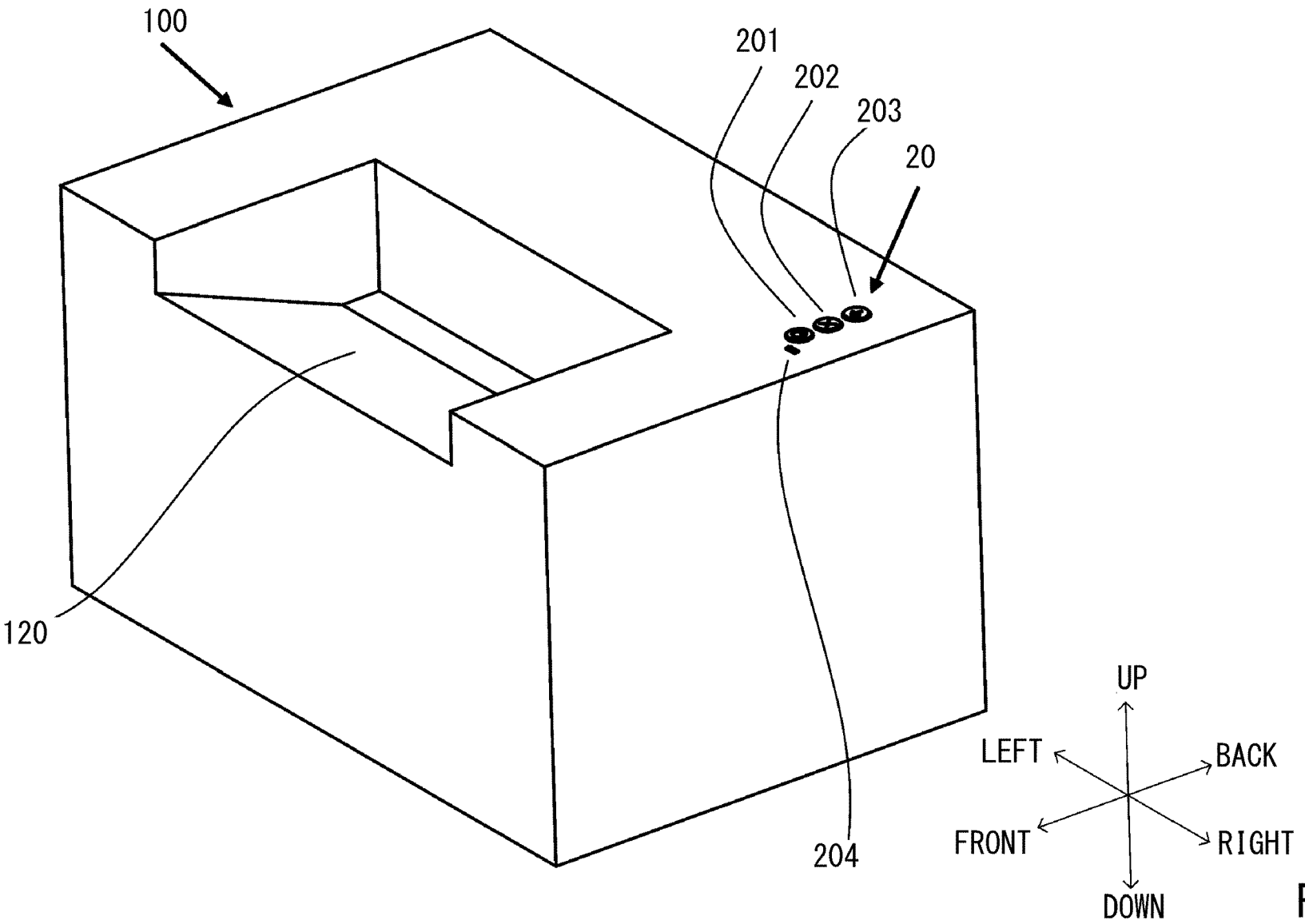
FIG. 2 is a perspective view of the laser beam printer in embodiment 1.

FIG. 2 shows an external view of the printer 100 in embodiment 1. Here, the vertical direction of the printer 100 is defined as shown in the figure, with the surface with the discharge tray 120 on top and the surface in contact with the installation site on the bottom. The top side of the printer 100 is defined as the front, and the side opposite the discharge tray is defined as the back. Furthermore, the left and right sides are defined when the printer 100 is viewed from the front. For example, the printer 100 has an operating unit 20 at the top of the printer 100. The operating unit 20 is not limited to the upper part of the printer 100, but can be installed at a location that is easy for the user to operate.

As shown in FIG. 2, in the embodiment 1, the operating unit 20 is installed at the right rear of the top of the printer 100. For example, there is a power button 201*a* to turn on/off the power of the printer 100 (not shown), a cancel button 202 to cancel a job, and a resume button 203 to resume printing. Next to the power button 201*a*, a status light guide 204 is provided to indicate whether the power is on or off by lighting up or not. The plurality of buttons on the operating unit 20 are pressed from upward to downward, and the direction in which they are pressed is hereinafter also referred to as the pressing direction. Two or more of the power button 201*a*, the cancel button 202, and the resume button 203 may also be collectively referred to simply as buttons.

[User Operation Portion Unit]

Figure 3:
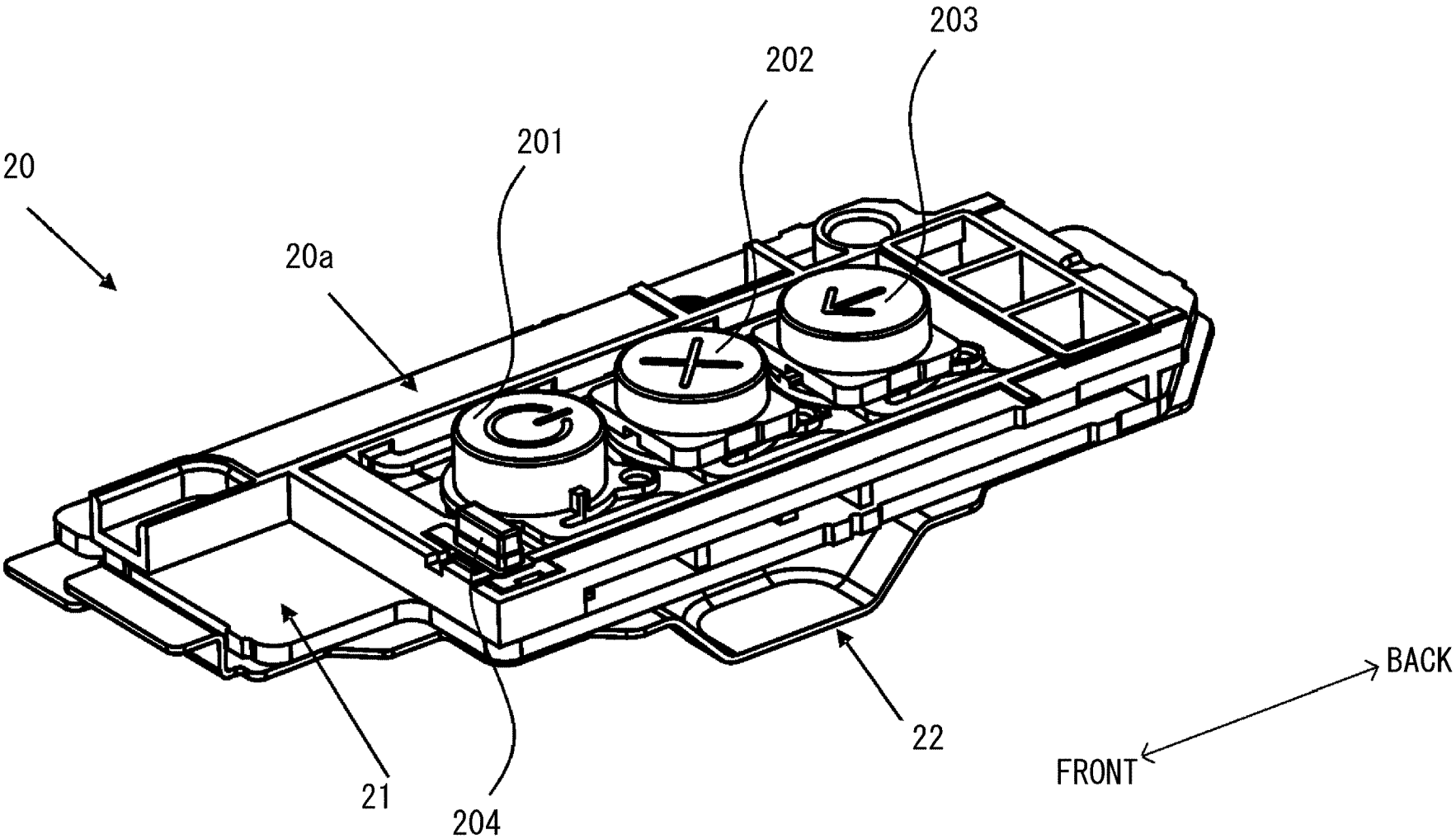
FIG. 3 is a perspective view showing the mounting configuration of the mechanical buttons in embodiment 1.
Figure 4:
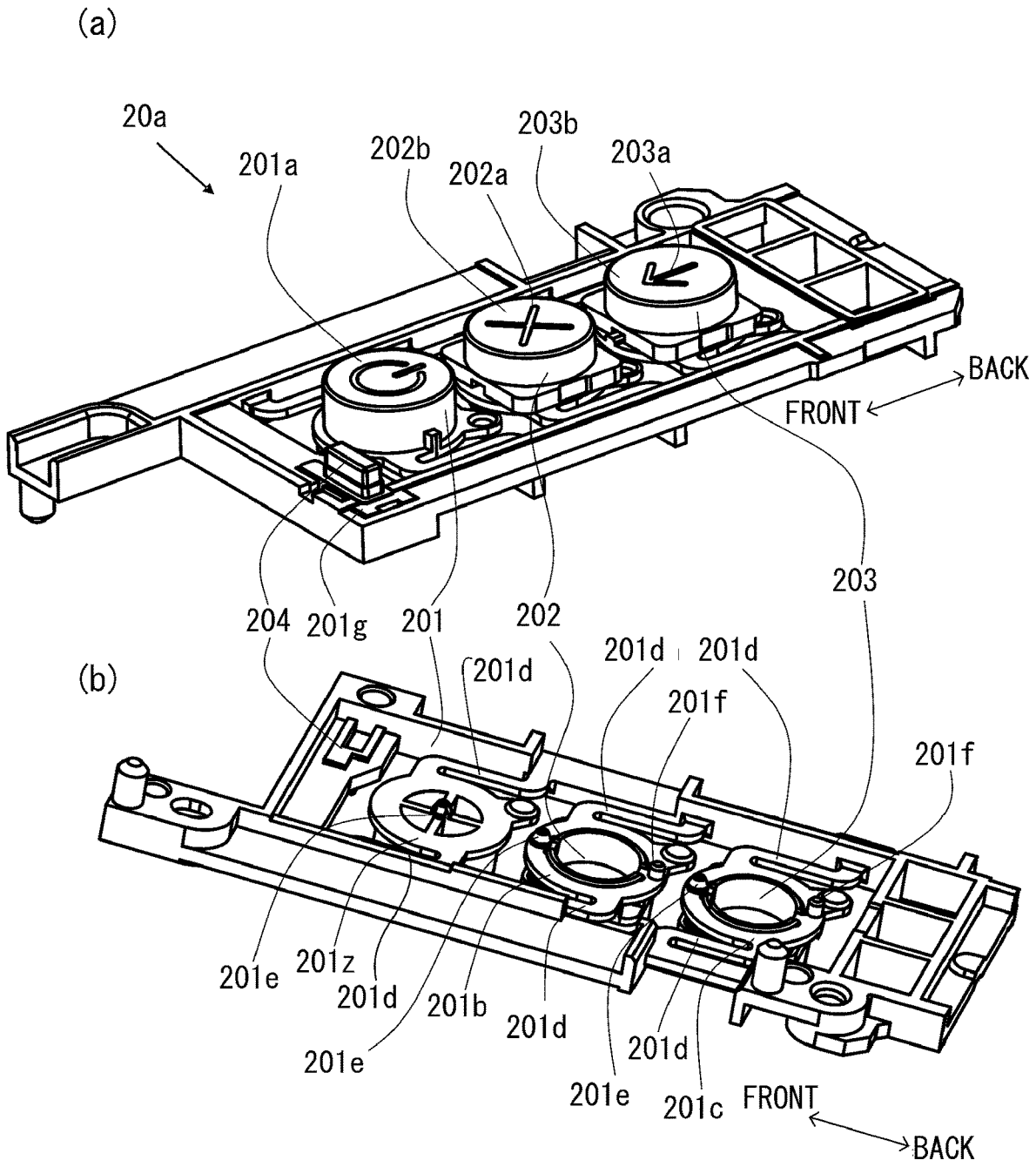
FIG. 4, part (a) and part (b), is a top and bottom perspective view showing the configuration of the mechanical buttons in embodiment 1.

FIG. 3 shows a perspective view of the operating unit, operating unit 20. The operating unit 20 has a button unit 20*a*, an operating substrate 21, and a fixing member 22. The button unit 20*a* has a button member 201 equipped with a power button 201*a*, a cancel button 202, a resume button 203, and a status light guide 204. The fixing member 22 is a member for fixing the operating unit 20 to the casing of the printer 100. Parts (a) and (b) of FIG. 4 show a perspective view of the button unit 20*a* when viewed from the top and bottom, respectively.

(Power Button)

The button member 201 has a power button 201*a*, a base portion 201*z*, a cancel button holding portion 201*b*, a resume button holding portion 201*c*, a button deforming portion 201*d*, a button contact portion 201*e*, and a status light guide holding portion 201*g*. The power button 201*a*, which is an operating portion, has its top surface exposed to the top surface of the printer 100 and is visible by the user. Two button deforming portions 201*d*, the first elastic portion and the second elastic portion, are connected to the base portion 201*z*. The two button deforming portions 201*d* flex by deforming when the power button 201*a* is pressed down, enabling the power button 201*a* to move up and down. The button pressing portion 201*e*, which is the pressing portion, is located below the power button 201*a*, and when the power button 201*a* is pressed, the switch on the board described below is made capable of being pressed. The button abutting portion 201*f*, which is the abutting portion, is not provided for the power button 201*a*, but is provided for the cancel button 202 and the resume button 203. Button abutting portion 201*f* is provided on the backside of the cancel button holding portion 201*b* and the resume button holding portion 201*c* of button member 201, respectively, and can make contact with parts of the board other than the switches.

(Cancel Button and Resume Button)

The cancel button 202 and the resume button 203 are separate from the button member 201 and have light transmitting portions 202*a* and 203*a*, which transmit light, and light blocking portions 202*b* and 203*b*, which block light, respectively. The cancel button 202 is held in the cancel button holding portion 201*b* of the button member 201, and the resume button 203 is held in the resume button holding portion 201*c*.

For the cancel button 202, two button deforming portions 201*d*, the first elastic portion and the second elastic portion, are also provided and connected to the cancel button holding portion 201*b*. The two button deforming portions 201*d* flex by deforming when the cancel button 202 is pressed, and support the light transmitting portion 202*a* and the light blocking portion 202*b* so that they can be moved in the vertical direction. The button pressing portion 201*e*, which is the operating portion, is located below the light transmitting portion 202*a* and the light blocking portion 202*b*, and presses the switch that the substrate has when the cancel button 202 is pressed. The button abutting portion 201*f*, which is the abutting portion, is located on the back side of the cancel button holding portion 201*b*.

Two button deforming portions 201*d*, the first elastic portion and the second elastic portion, are also provided for the resume button 203 and are connected to the resume button holding portion 201*c*. The two button deforming portions 201*d* are deformed when the resume button 203 is pressed and deformed, enabling the light transmitting portion 203*a* and the light blocking portion 203*b* to be moved in the vertical direction. The button pressing portion 201*e*, which is the operating portion, is located below the light transmitting portion 203*a* and the light blocking portion 203*b*, and presses the switch that the board has when the resume button 203 is pressed. The abutting portion, button abutting portion 201*f*, is located on the back of the resume button holding portion 201*c*. Also, the status light guide 204 is held in the status light guide holding section 201*g*.

Button member 201 has no light emitting diode (hereinafter referred to as LED) below the power button 201*a* (i.e., there is no light transmitting portion), so the button member 201 has a button pressing portion 201*e* in the center of the base 201*z*. On the other hand, the button pressing portions 201*e* of the cancel button 202 and the resume button 203 are located in front of the center of each button because there are LEDs (i.e., light transmitting portions 202*a* and 203*a*) in the center of each button, respectively. In addition, the button abutting portions 201*f* of the cancel button 202 and the resume button 203 are located at the back side of each button because there are LEDs (i.e., light transmitting portions 202*a* and 203*a*) in the center of each button.

Thus, when the cancel button 202 or the resume button 203 is viewed from the pressing direction, the switches of the board and the button pressing portion 201*e* are located outside the center of the button. In addition, the virtual line (BB') connecting one of the two button deforming portions 201*d* with each button holding portion and the connecting portion between the other of the two button deforming portions 201*d* and each button holding portion (See FIG. 6), the button abutting portion 201*f* is located on one side and the button pressing portion 201*e* is located on the other side. Here, each button holding portion refers to the cancel button holding portion 201*b* and the resume button holding portion 201*c*. Furthermore, the button abutting portion 201*f* is located at the position overlapping with a contour of the cancel button 202 or the resume button 203. This assumes that the user operates the product mainly from the front side of the product, and is set so that force is more easily applied when the user operates the product.

In embodiment 1, the power button 201*a* of the button member 201, the light blocking portion 202*b* of the cancel button 202, and the light blocking portion 203*b* of the resume button 203 are formed of a different material than the corresponding button pressing portion 201*e*. It is also possible that the operating portion of each button and each button pressing portion 201*e* are formed of the same material. Also, in embodiment 1, each button pressing portion 201*e* and each button abutting portion 201*f* are formed of a different material. It is also possible that each button pressing portion 201*e* and each button abutting portion 201*f* are formed of the same material. Furthermore, in the embodiment 1, the button member 201 holds the cancel button 202 and the resume button 203 by means of the cancel button holding portion 201*b* and the resume button holding portion 201*c*, which are integrated with the base 201*z*, but independent holding portions may be provided for each button.

[Operating Substrate]

Figure 5:
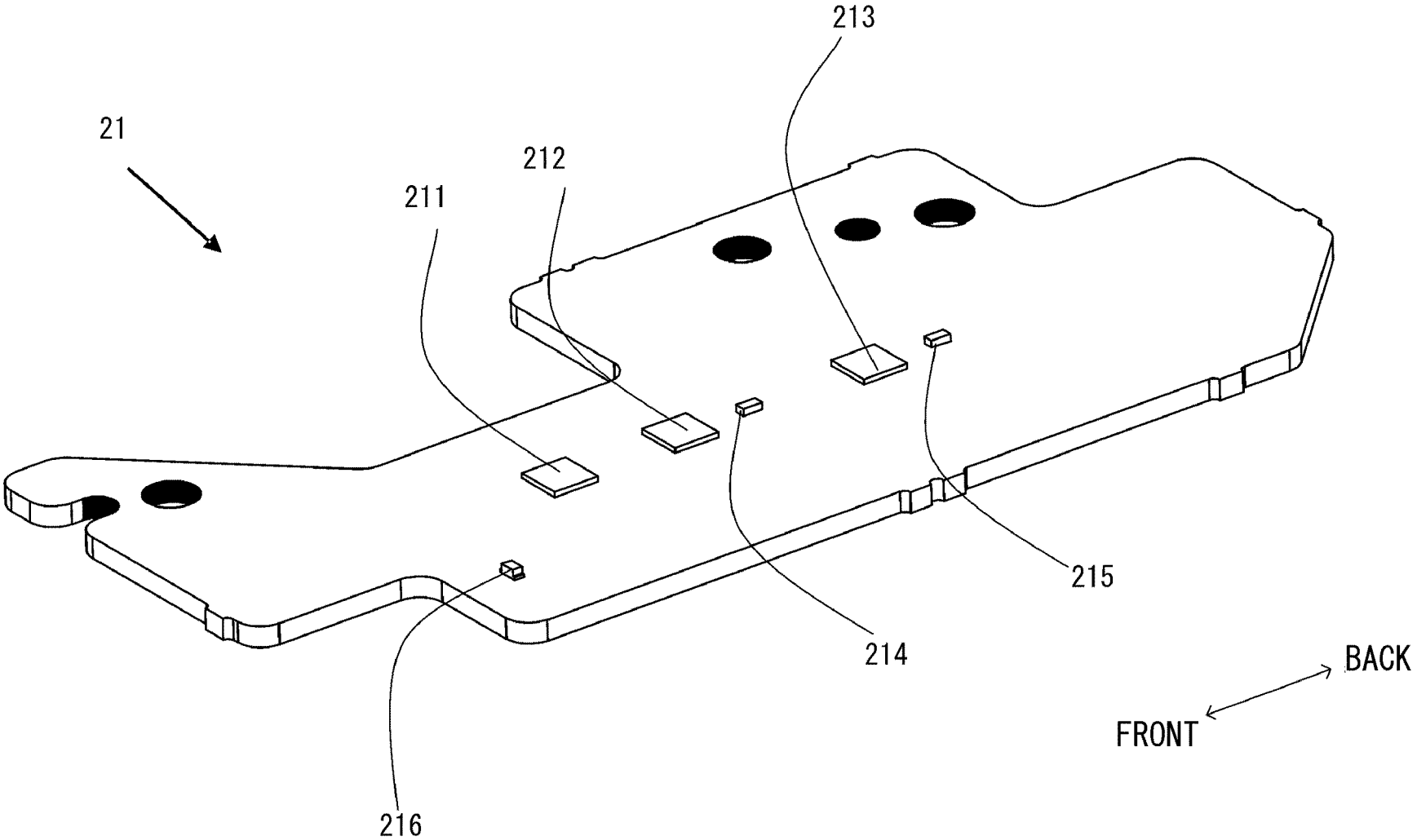
FIG. 5 is a perspective view showing the configuration of the operating substrate in embodiment 1.

FIG. 5 shows a perspective view of the unit explaining the configuration of the operating substrate 21, the substrate of the embodiment 1. The operating substrate 21 shown in FIG. 5 has the power tactile switch 211, cancel tactile switch 212, and resume tactile switch 213, which are the switches of the substrate described above. Two or more of the power tactile switch 211, cancel tactile switch 212, and resume tactile switch 213 may be collectively referred to simply as switches. In addition, the operating substrate 21 has a cancel LED 214 at a position adjacent to a central portion, or light transmitting portion 202*a*, of the cancel button 202 when viewed from the pressing direction. L The operating substrate 21 has resume LED 215 located adjacent to a central portion of the resume button 203, i.e. light transmitting portion 203*a*. Furthermore, the operating substrate 21 has a status LED 216 at the location of the status light guide 204.

The power tactile switch 211 makes contact with the button pressing portion 201*e* when the button member 201 is pressed. The cancel tactile switch 212 makes contact with the button pressing portion 201*e* when the cancel button 202 is pressed. The resume tactile switch 213 makes contact with the button pressing portion 201*e* when the resume button 203 is pressed. The operating substrate 21 is connected to the control substrate of the control portion 200, and the status of each switch is input to the control portion 200 as a signal, for example, so that the control portion 200 can control the printer 100 according to the pressed button. The light emitted from the cancel LED 214 passes through the light transmitting portion 202*a*, and the light emitted from the resume LED 215 passes through the light transmitting portion 203*a*. As a result, each button itself emits light and visibility is improved.

[Location of Buttons, Contact Portions, and Abutting Portions]

Figure 6:
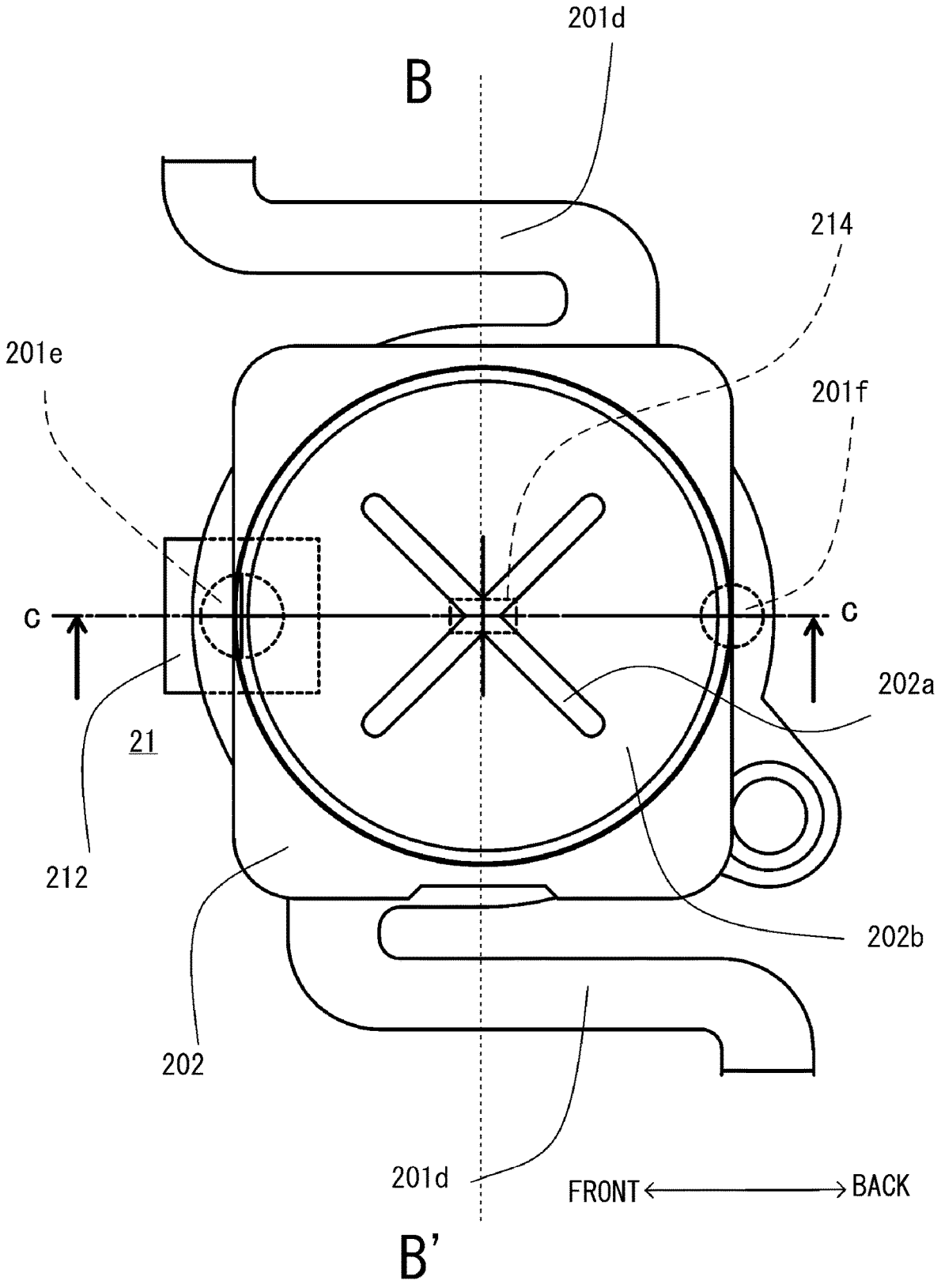
FIG. 6 is an enlarged view showing the configuration of the mechanical button in embodiment 1.
Figure 7:
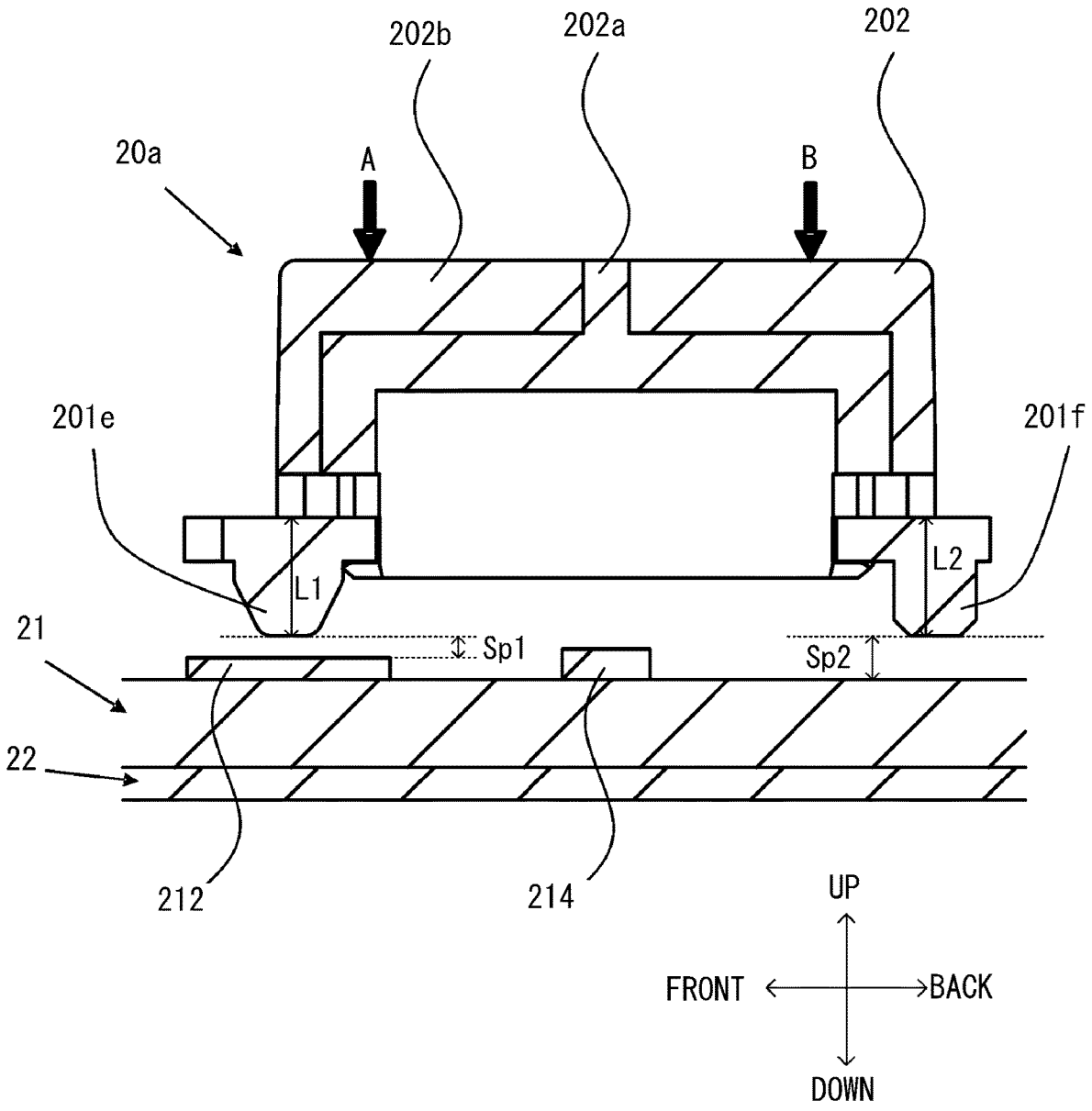
FIG. 7 is a cross-sectional view showing the function of the mechanical button and operating substrate in embodiment 1.

FIG. 6 is an enlarged view showing the configuration of the mechanical buttons in the embodiment 1. FIG. 6 shows the positional relationship of the button pressing portion 201*e* and button abutting portion 201*f* in vicinity of the cancel button 202. FIG. 7 is a C-C cross-sectional drawing of FIG. 6, which illustrates the action of the mechanical buttons and operating substrate of the embodiment 1. Here, the length L1 in the vertical direction of the button pressing portion 201*e* is longer than the length L2 in the vertical direction of the button abutting portion 201*f* (L1>L2). When the distance between the button pressing portion 201*e* and the cancel tactile switch 212 (gap) is Sp1, and the distance between the button abutting portion 201*f* and the operating substrate 21 (gap) is Sp2, the relationship is Sp2>Sp1.

Figure 8:
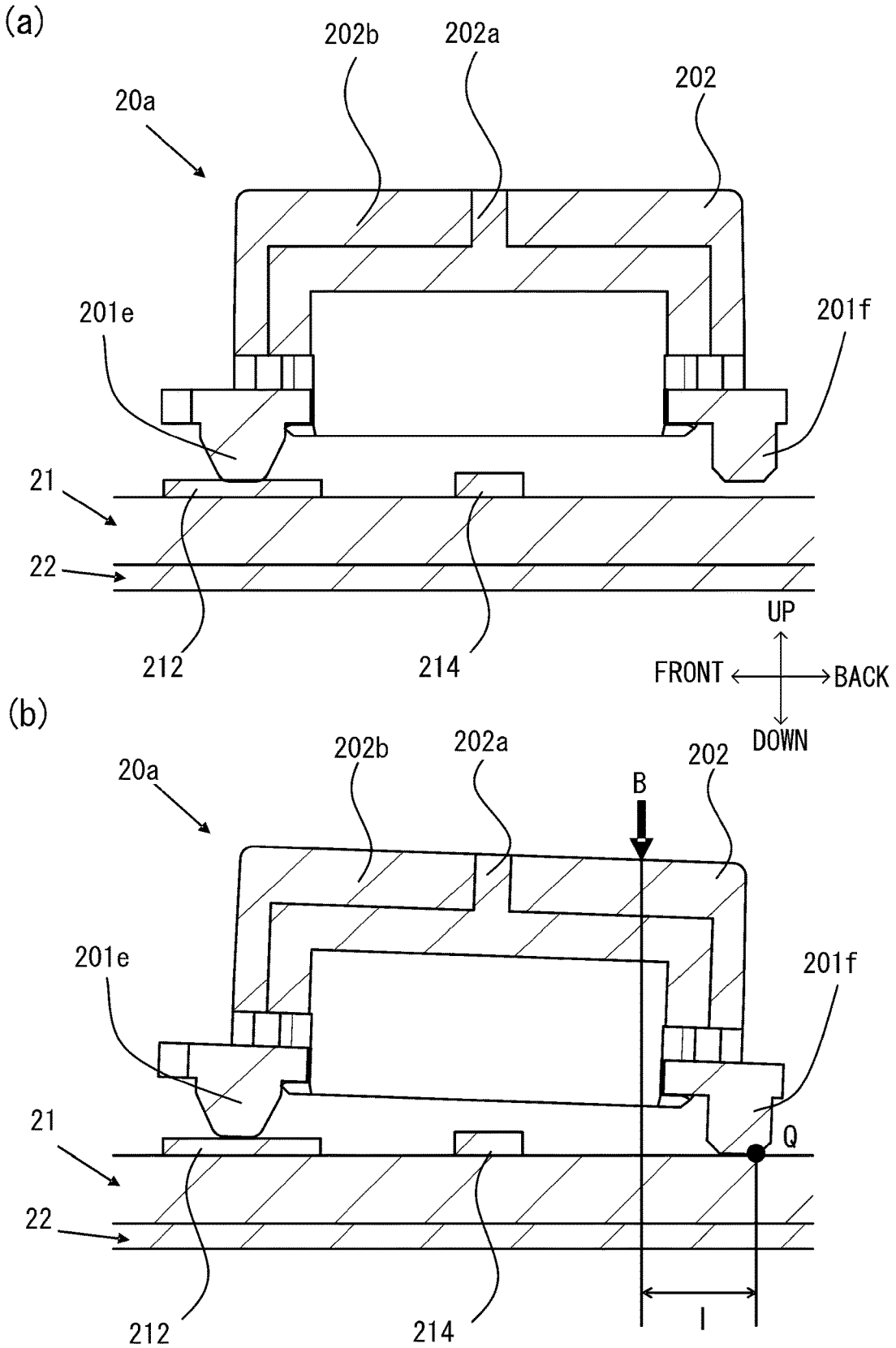
FIG. 8, part (a) and part (b), is a cross-sectional view showing the function of the mechanical button and operating substrate of embodiment 1.

When the force is applied to the arrow A in FIG. 7, the cancel button 202 and the button pressing portion 201*e* sink downward as shown in part (a) of FIG. 8. Then, the button pressing portion 201*e* comes into contact with the cancel tactile switch 212, and the cancel tactile switch 212 is switched on and off. On the other hand, when the force is applied to the arrow B, first of all, as when the force is applied to the arrow A, the cancel button 202 and the button pressing portion 201*e* sink downward, and the button pressing portion 201*e* and the cancel tactile switch 212 make contact.

However, it can be assumed that the force of the arrow B is not sufficiently transmitted to the cancel tactile switch 212 and the cancel tactile switch 212 is not switched on and off. In this case, as shown in part (b) of FIG. 8, the operating substrate 21 and the button abutting portion 201*f* come into contact. Here, the contact area between the operating substrate 21 and the button pressing portion 201*e* is defined as contact area Q. As a result, the force indicated by the arrow B is transmitted to the cancel tactile switch 212 as a momentary force in accordance with the distance 1 around the contact area Q between the operating substrate 21 and the button abutting portion 201*f*, and the cancel tactile switch 212 is switched on and off. The same applies to the resume button 203, and the explanation is omitted.

By using such a configuration, it is possible to ensure high visibility and usability by placing the LED near the center of the button, and to provide a highly operable control unit that supports downsizing with less space. As described above, embodiment 1 enables usability to be maintained even when the product is downsized.

Exemplary Embodiment 2

[Prevention Boss]

Figure 9:
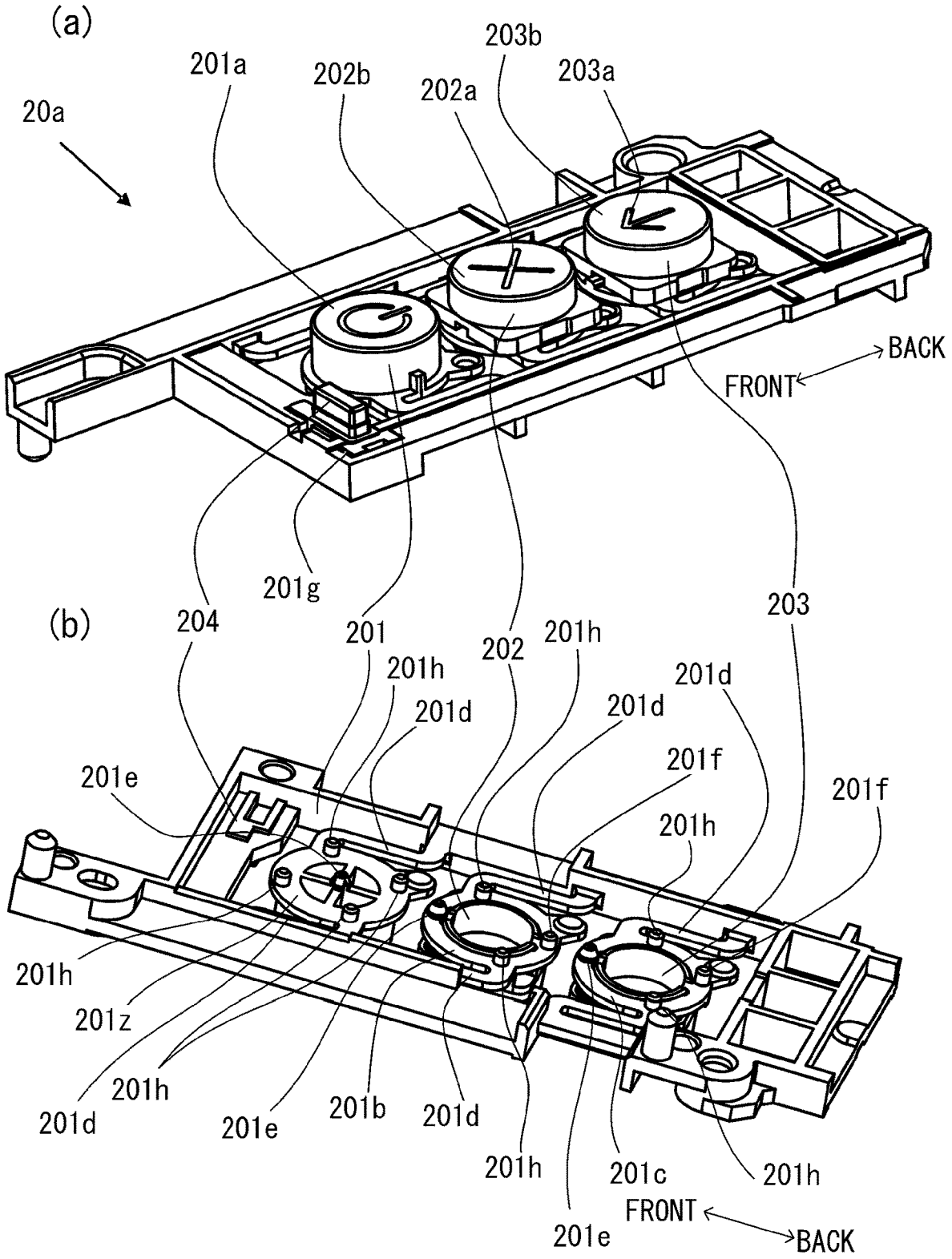
FIG. 9, part (a) and part (b), is a top and bottom perspective view showing the configuration of the mechanical buttons in embodiment 2.

FIG. 9 is a perspective view showing the configuration of the mechanical buttons in the unit of embodiment 2. The same configuration as described in FIG. 4 of embodiment 1 is indicated with the same reference numeral and is omitted from the explanation. The difference from the embodiment 1 is that the button member 201 has a plurality of prevention bosses 201*h*, which are different abutting portions to prevent over-pressing of the button member 201, as shown in FIG. 9. Also, the cancel button 202 and the resume button 203 also have a plurality of prevention bosses 201*h*. In FIG. 9, as an example, the button member 201 has four prevention bosses 201*h* at positions that are symmetrical around the button pressing portion 201*e* on the base portion 201*z*. In addition, the cancel button 202 and the resume button 203 are each provided with two prevention bosses 201*h*.

The gap between the prevention boss 201*h* and the operating substrate 21 (hereinafter referred to as Sp3) is the same (Sp3=Sp2) or wider (Sp3>Sp2) than the gap between the button abutting portion 201*f* and the operating substrate 21 (Sp2 as described above). In other words, the distance between the prevention boss 201*h* and the operating substrate 21 is greater than the distance between the button abutting portion 201*f* and the operating substrate 21. Before the prevention boss 201*h* contacts the operating substrate 21, the force is transmitted to the cancel tactile switch 212, and the cancel tactile switch 212 is switched on and off. In addition, when the user presses the cancel button 202 strongly, the prevention boss 201*h* comes in contact with the operating substrate 21 to compensate for the tilt of the cancel button 202, thereby providing a highly usable control portion. The same applies to the resume button 203, which is omitted from the description.

Thus, each button of the embodiment 2, apart from the button abutting portion 201*f*, has a prevention boss 201*h* that prevents the displacement of each control portion from becoming more than a certain level when each control is applied, and prevents each button from being pressed too much. The prevention bosses 201*h* are arranged one or more at the position overlapping with a contour of the control portion of each button when viewed from the pressing direction. The prevention bosses 201*h* may be placed in position non-overlapping with the cancel button 202 or the resume button 203. As for the material of the prevention boss 201*h*, it may be a different material from the button abutting portion 201*f* or the same material.

As described above, embodiment 2 can maintain operability even when the product is downsized.

Exemplary Embodiment 3

[Button Abutting Portion]

Figure 10:
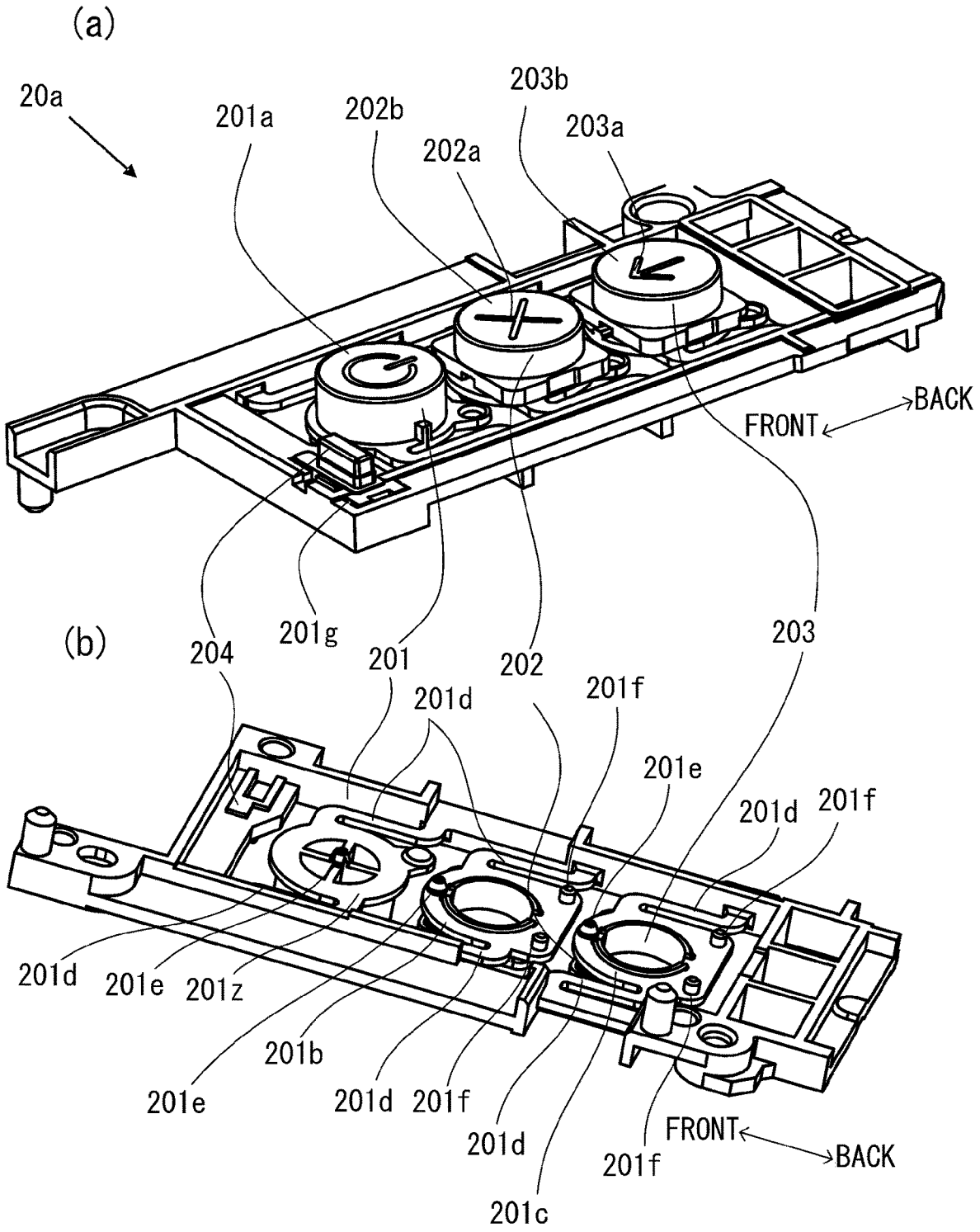
FIG. 10, part (a) and part (b), is a top and bottom perspective view showing the configuration of the mechanical buttons in embodiment 3.

FIG. 10 is a perspective view of the configuration of the mechanical buttons in embodiment 3. The same configuration as described in FIG. 4 of embodiment 1 is indicated with the same reference numeral and is omitted from the explanation. The difference from embodiment 1 is that, as shown in FIG. 10, there are more button abutting portions 201*f* on the back of the cancel button holding portion 201*b* and the resume button holding portion 201*c* of the button member 201 than there are button pressing portions 201*e*. For example, in embodiment 1, one button abutting portion is provided in each holding portion, but in embodiment 3, two button abutting portions are provided in each holding portion. In order to provide multiple button abutting portions 201*f*, the shape of each holding portion is also changed. As a result, in the embodiment 3, a plurality of button abutting portions 201*f*, which are larger than the number of button pressing portions 201*e*, are positioned non-overlapping with the cancel button 202 or the resume button 203.

By having more button abutting portions 201*f* than button pressing portions 201*e*, it is possible to compensate for the tilt of the button even when the edges of the button are pressed by the user, and to provide a highly usable control portion. In addition, the configuration of embodiment 3 can be configured to include the prevention boss 201*h* of embodiment 2.

As described above, embodiment 3 allows us to maintain operability even when the product is downsized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-142053 filed on Aug. 25, 2020, which is hereby incorporated by reference herein in its entirety.

What is claimed is:

1. An image forming apparatus comprising:

an image forming unit configured to form an image on a recording material;

a control substrate configured to control said image forming unit; and an operating unit connected to said control substrate, wherein said operating unit includes a button capable of being pressed by a user, a button member configured to hold said button, and a substrate including a switch provided below said button member and pressed by said button being pressed, wherein said button member includes a pressing portion for pressing said switch, a first elastic portion elastically deformed and connected to said pressing portion, a second elastic portion elastically deformed and connected to said pressing portion, and an abutting portion capable of contacting a portion other than said switch of said substrate, wherein when viewing said button from a pressing direction, said switch and said pressing member are disposed in a place other than a center of said button, said abutting portion is positioned in one side and said pressing portion is in the other side with respect to a virtual line connecting a first connecting portion connecting said first elastic portion and said button, and a second connecting portion connecting said second elastic portion and said button, and said abutting portion is disposed on a position overlapping with a contour of said button or a position non-overlapping with said button.

2. An image forming apparatus according to claim 1, wherein as viewed in the pressing direction, said substrate is provided with a light emitting diode adjacent to a central portion of said button, and wherein said button is provided with a transmitting portion for transmitting a light from said light emitting diode.

3. An image forming apparatus according to claim 1, wherein said button is formed of a material different from that of said pressing portion.

4. An image forming apparatus according to claim 1, wherein said button is formed of a material different from that of said abutting portion.

5. An image forming apparatus according to claim 4, wherein said button is provided with a second abutting portion other than said abutting portion, and wherein said second abutting portion restricts a displacement of said button when said button is pressed.

6. An image forming apparatus according to claim 5, wherein as viewed in the pressing direction, said second abutting portion is disposed on a position overlapping with a contour of said button or a position non-overlapping with said button.

7. An image forming apparatus according to claim 6, wherein a distance between said second abutting portion and said substrate is set no shorter than a distance between said abutting portion and said substrate.

8. An image forming apparatus according to claim 1, wherein said operating unit is provided with a second button different from said button and capable of being pressed by the user.

9. An image forming apparatus according to claim 8, wherein said substrate is provided with a second switch pressed by said second button being pressed, wherein said button member is provided with a second pressing member for pressing said second switch, and wherein when viewing said second button from a pressing direction, said second switch and said second pressing member are disposed in a center of said second button.

10. An image forming apparatus comprising:

an image forming unit configured to form an image on a recording material;

a discharging tray configured to discharge the recording material with the image formed thereon;

a control substrate configured to control said image forming unit; and an operating unit connected to said control substrate, wherein said operating unit includes a button capable of being pressed by a user, a button holding member configured to hold said button, and a substrate including a switch provided below said button holding member and pressed by said button being pressed, wherein said button holding member includes a pressing portion for pressing said switch, and an abutting portion capable of contacting a portion other than said switch of said substrate, wherein when viewing said button from a pressing direction, said switch and said pressing member are disposed in a place other than a center of said button, said abutting portion is disposed on an upstream side of said pressing member and said switch with respect to a feeding direction of the recording material to said discharging tray.

11. An image forming apparatus according to claim 10, wherein when viewing said button from a pressing direction, said abutting portion is disposed on a position overlapping with a contour of said button or a position non-overlapping with said button.

12. An image forming apparatus according to claim 10, wherein when viewing said button from a pressing direction, a contact area between said abutting portion and said control substrate is positioned on an upstream side of a contour of said button with respect to the feeding direction of the recording material.

13. An image forming apparatus according to claim 12, wherein as viewed in the pressing direction, said substrate is provided with a light emitting diode adjacent to a central portion of said button, and wherein said button is provided with a transmitting portion for transmitting a light from said light emitting diode.

14. An image forming apparatus according to claim 12, wherein said button is formed of a material different from that of said pressing portion.

15. An image forming apparatus according to claim 12, wherein said button is formed of a material different from that of said abutting portion.

* * * * *